United States Patent [19]

Kimura et al.

[11] Patent Number: 4,471,028

[45] Date of Patent: Sep. 11, 1984

[54] HONEYCOMB CORE DIAPHRAGM

[75] Inventors: Masami Kimura; Masayasu Yamaguchi, both of Saitama, Japan

[73] Assignee: Pioneer Electronic Corporation, Tokyo, Japan

[21] Appl. No.: 377,770

[22] Filed: May 13, 1982

[30] Foreign Application Priority Data

May 14, 1981 [JP] Japan ..... 56-71330

[51] Int. Cl.[3] ..... H04R 7/00; B22D 11/06

[52] U.S. Cl. ..... 428/593; 428/626; 428/118; 428/649; 164/463; 148/403

[58] Field of Search ..... 420/401; 428/116, 118, 428/593, 626, 649; 164/463; 148/403

[56] References Cited

U.S. PATENT DOCUMENTS

| | | | |
|---|---|---|---|
| 1,759,632 | 5/1930 | Scheuch | 420/401 |
| 2,793,718 | 5/1957 | Pajak | 428/118 |
| 3,089,227 | 5/1963 | Yans | 420/401 |
| 3,117,001 | 1/1964 | Crossley | 420/401 |
| 3,174,850 | 3/1965 | Hum | 420/401 |
| 3,563,840 | 2/1971 | Stine | 428/118 |
| 3,600,257 | 8/1971 | Reinhardt | 428/118 |
| 3,895,671 | 7/1975 | Suzuki | 164/46 |
| 3,989,517 | 11/1976 | Tanner et al. | 148/3 |
| 4,011,076 | 3/1977 | Hovis et al. | 148/126 |
| 4,050,931 | 9/1977 | Tanner et al. | 75/134 N |
| 4,118,222 | 10/1978 | Tanner | 75/134 V |
| 4,250,229 | 2/1981 | Kear et al. | 428/606 |
| 4,315,557 | 2/1982 | Nakaya et al. | 428/118 |
| 4,410,768 | 10/1983 | Nakamura et al. | 179/115.5 R |

FOREIGN PATENT DOCUMENTS

| | | | |
|---|---|---|---|
| 39804 | 11/1979 | Japan | 420/401 |
| 9095 | 8/1981 | Japan | 428/116 |
| 9096 | 8/1981 | Japan | 428/116 |
| 2031691 | 4/1980 | United Kingdom | 428/116 |

OTHER PUBLICATIONS

"Aviation Week", Beryllium Offers High Structural Promise", Stone, McGraw-Hill, Dec. 17, 1956.

"Metallic Glasses", Wurlimont The Institute of Physics, 1980.

*Primary Examiner*—L. Dewayne Rutledge

*Assistant Examiner*—John J. Zimmerman

*Attorney, Agent, or Firm*—Sughrue, Mion, Zinn, Macpeak & Seas

[57] ABSTRACT

A honeycomb core diaphragm is described, which contains a honeycomb core made from a thin plate of beryllium or beryllium alloy which is produced by a super-rapid cooling method. Since the thin plate of beryllium or its alloy has a high modulus of elasticity and low density and, furthermore, is easily moldable, it can be easily molded to produce a honeycomb core having a high modulus of elasticity and low density.

13 Claims, 5 Drawing Figures

HONEYCOMB CORE DIAPHRAGM

BACKGROUND OF THE INVENTION

The present invention relates to a honeycomb core diaphragm, and more particularly, to a honeycomb core diaphragm containing, as a core material, a honeycomb material which is made from a thin plate of beryllium or a beryllium alloy.

In general, a diaphragm utilizing a honeycomb core is used specifically as a planar diaphragm because it has a greater stiffness than a diaphragm made of paper and, furthermore, its apparent mass is small. In the production of such diaphragms, it is desirable to use materials of high stiffness and low density in order to increase the efficiency of the diaphragm and to extend the piston motion zone. Thus, in view of molding ease, aluminum has heretofore been used to produce a honeycomb core diaphragm.

Beryllium is greater in stiffness than aluminum and, furthermore, its density is smaller than that of aluminum. If, therefore, beryllium could be used to produce a honeycomb core, there would be produced a honeycomb core diaphragm which realizes a piston motion of higher efficiency within a wider zone as compared with the conventional diaphragm containing an aluminum hoenycomb core. Beryllium, however, is difficult to mold, and a thin plate of beryllium has heretofore been produced only by a vacuum deposition method. In accordance with this method, it is impossible to produce a honeycomb core. Thus, a diaphragm using a honeycomb core made of beryllium or its alloy has not heretofore been produced.

It has been found that a thin plate of beryllium or its alloy produced by a super-rapid cooling method, i.e., by jetting molten beryllium through a nozzle onto a single roll or a pair of rolls rotating at a high speed to cool it abruptly on the surface of the roll, has a nearly uniform width and thickness and, furthermore, that the thin plate of beryllium or its alloy so formed has very good workability that permits press-forming at ordinary temperatures, because the crystal grains are dense and finely divided.

SUMMARY OF THE INVENTION

The object of the invention is to provide a diaphragm containing a honeycomb core which is fabricated from a thin plate of beryllium or its alloy produced by a super-rapid cooling method.

The present invention, therefore, relates to a honeycomb core diaphragm containing, as a core material, a honeycomb material which is made from a thin plate of beryllium or an alloy composed primarily of beryllium wherein the thin plate of beryllium or its alloy is produced by a super-rapid cooling method.

DETAILED DESCRIPTION OF THE PREFERRED EMBODIMENTS

The invention will hereinafter be explained in detail with reference to the accompanying drawings.

Figure 1:
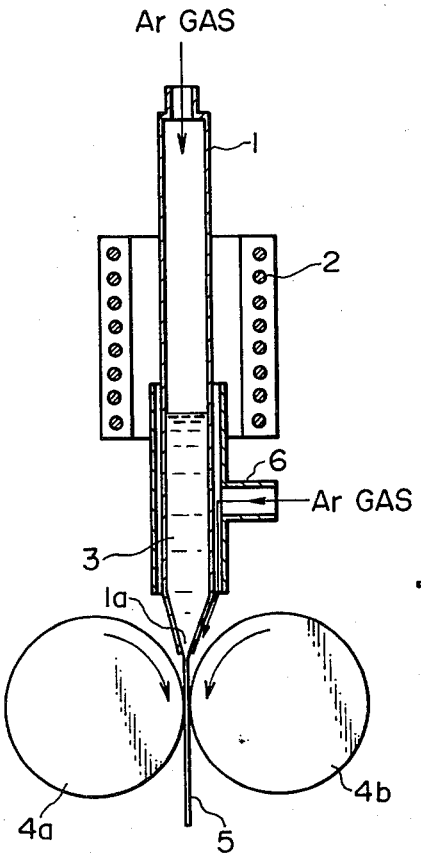
FIG. 1 is a cross-sectional view of an apparatus for use in the production of a thin plate of beryllium or its alloy used to fabricate a honeycomb core of the diaphragm of the invention.
Figure 2:
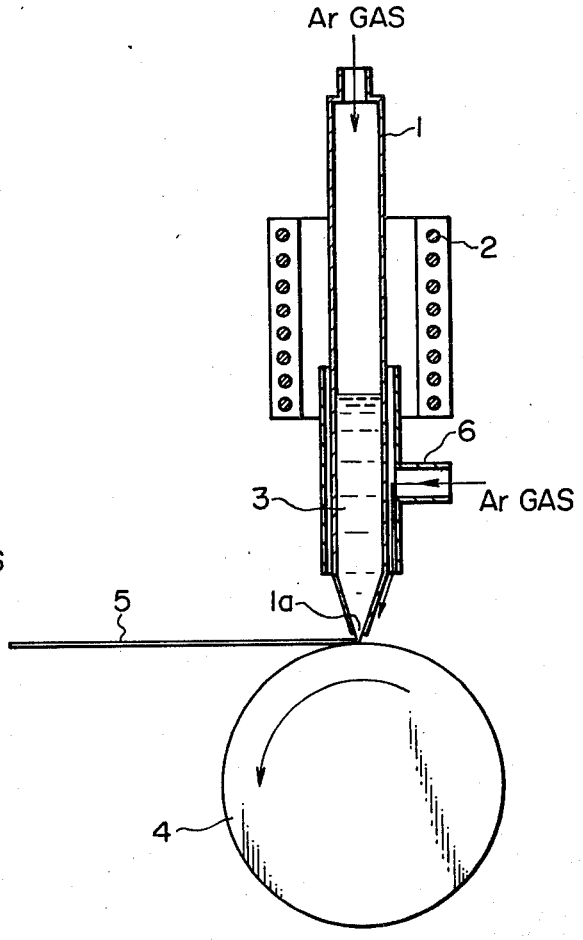
FIG. 2 is a cross-sectional view of another apparatus for use in the production of a thin plate of beryllium or its alloy used to fabricate a honeycomb core of the diaphragm of the invention.

FIGS. 1 and 2 illustrated a single-roll and a double-roll production system, respectively. Referring to FIGS. 1 and 2, a beryllium or beryllium alloy parent material 3 is placed in a nozzle 1 and heated by a heating unit 2, and the resulting molten parent material is jetted through a jetting hole 1*a* provided at the end thereof to the space between rolls 4*a* and 4*b* (FIG. 1) or onto a single roll 4 (FIG. 2). The molten parent material thus jetted is rapidly cooled by the rolls 4*a* and 4*b*, or by the single roll 4 and is formed continously into a thin plate 5. An inert gas, e.g., argon, is introduced through a gas conduit 6 to the jetting hole 1*a* of the nozzle 1 to prevent the parent material 3 inside from being oxidized by the air. By feeding a high pressure inert gas, e.g., argon, into the nozzle 1, the molten parent material 3 is jetted from the nozzle.

The following production examples of a thin plate of beryllium or its alloy are given below to explain the invention in greater detail.

PRODUCTION EXAMPLE 1

In this example, an apparatus of the double-roll type shown in FIG. 1 was employed.

The nozzle 1 was made of silica glass and had a diameter of 13 mm, and was provided with a jetting hole 1*a* having a diameter of 0.2 mm at the end thereof. As the heating unit 2, resistance heating apparatus was used. The rolls 4*a* and 4*b* were made of chromium-plated stainless steel, and each had a diameter of 50 mm. The speed or rotation thereof was 2,500 r.p.m. and, therefore, the linear speed was 6.5 m/sec.

From 1.5 to 2.0 g of a beryllium parent material was placed in the nozzle 1 and was melted by heating to 1,300 to 1,400° C. by means of the heating unit 2. By raising the pressure of the argon in the nozzle 1 to from 0.6 to 1 kg/cm$^2$, the molten parent material 3 was jetted onto the rolls 4*a* and 4*b* through the jetting hole 1*a*. In this manner, a thin plate of beryllium was produced which had a width of about 5 mm, a length of about 4 m, and a thickness of about 30 $\mu$m.

The physical properties of the thus-produced thin plate of beryllium were measured; modulus of elasticity: $E=2.0\times10^{11}$ $-2.3\times10^{11}$N/m$^2$ and density; $\rho=1.75-1.85$ g/cm$^3$. These values are nearly equal to those of a thin plate of beryllium produced by a vacuum deposition method. Crystal grains had diameters less than about 5 $\mu$m, and many columnar crystals extended not only in the direction perpendicular to the surface of the plate but also in the oblique direction. Since each crystal had a complicated structure, the thin plate could be easily wound on a rod having a diameter of 10 mm. Thus the thin plate of beryllium of the invention exhibited flexible plasticity which could not be expected of the conventional thin plate of beryllium.

PRODUCTION EXAMPLE 2

In this example, an apparatus of the single-roll type shown in FIG. 2 was employed to produce a wide thin-plate of beryllium.

The nozzle 1 was provided with a jetting hole 1*a* in the form of a slit which was 15 mm long and 0.1 mm wide. The roll 4 was made of copper or a copper alloy, and had a diameter of 400 mm. The speed of rotation was 150 r.p.m.

A beryllium parent material 3 which had been melted by heating in the nozzle 1 was jetted onto the roll 4 to produce a thin plate. The thin plate thus produced had a width of about 15 mm and a thickness of about 30 μm. The physical properties and crystal grains thereof were measured, with the result that they were nearly equal to those in Production Example 1.

In the above Production Examples 1 and 2, the thickness of the thin plate can be reduced by increasing the linear speed of the roll. It is also possible to increase the width of the thin plate by increasing the size of the jetting hole. Furthermore, by extending the width of the jetting hole, the width of the thin plate can be increased. In addition to beryllium, alloys composed primarily of beryllium and containing 15% by weight or less of non-ferrous metals such as aluminum, copper, titanium, zinc, chromium, nickel, boron, and zirconium can be used as parent materials.

The thus-produced thin plate of beryllium has high toughness unlike ordinary beryllium because of its reduced thickness, fine crystal grains, and lack of definite directionality of the crystal column and, therefore, it can be subjected to cold press-molding. Heat-treatment removes air bubbles, etc., in the thin plate, increasing its density and further increasing its toughness. This heat-treatment is performed in a vacuum or in a non-oxidizing atmosphere, e.g., argon gas, at a temperature of from 200° to 700° C. for a period of from 1 to 3 hours.

The method of producing the honeycomb core will now be explained.

Figure 3:
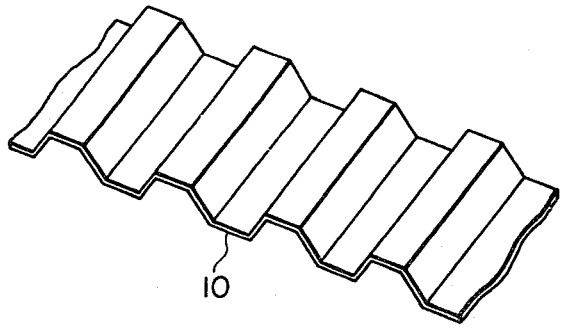
FIG. 3 is a perspective view of a corrugated thin plate of beryllium used to fabricate a honeycomb core of the honeycomb core diaphragm of the invention.

The thin plate of beryllium as produced above can be cold worked because of its good moldability. In the first instance, a corrugated molding 10 as shown in FIG. 3 is produced by the use of a press mold. The corrugated molding 10 may take various waveforms, e.g., a sine-wave. A molding having such curvature can be molded more easily because it has no sharp edges. On the other hand, when a molding having a complcated and pulse-like waveform is to be produced, hot press molding is employed and performed at a temperature of from 700° to 800° C. In this molding method, the width is made even by cutting off the edge simultaneously with molding.

Figure 4:
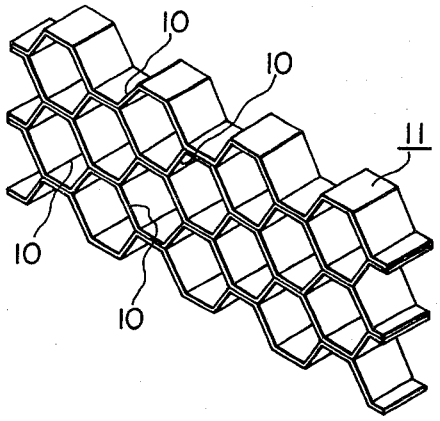
FIG. 4 is a perspective view of the honeycomb core of the honeycomb core diaphragm of the invention.
Figure 5:
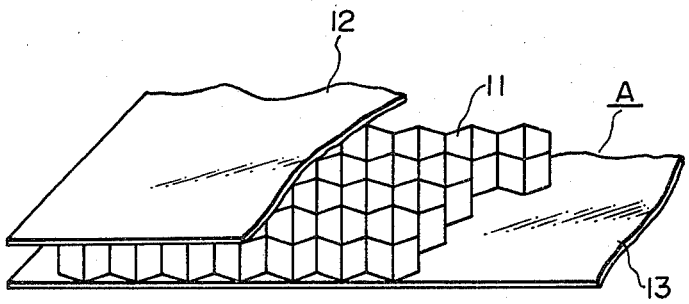
FIG. 5 is a perspective view, partially cut away, of the honeycomb core diaphragm of the invention.

A plurality of corrugated moldings 10 are then arranged as shown in FIG. 4 and joined together by bonding them with a metal adhesive such as an epoxy resin to produce a honeycomb core 11. The thus-produced honeycomb core 11 is then sandwiched between skin materials 12 and 13 as shown in FIG. 5 to produce a diaphragm A. It is preferred for these skin materials to be made of materials having a high stiffness and modulus of elasticity, and low density, e.g., aluminum, titanium, and beryllium. When beryllium is used to produce a skin material, a thin plate of beryllium produced by the super-rapid cooling method as described in Production Example 2 can be used.

The honeycomb core diaphragm of the invention, as described hereinbefore, contains a honeycomb core made of an easily moldable thin plate of beryllium or its alloy which is produced by a super-rapid cooling method. This increases the yield and permits mass-production. Furthermore, since the honeycomb core made from a thin plate of beryllium or its alloy has a high modulus of elasticity and a low density, the diaphragm of the invention has a high modulus of elasticity and a low density. Thus the honeycomb core diaphragm of the invention is lighter and more efficient than the conventional honeycomb core diaphragm made from an aluminum plate, and the piston motion region can be extended.

What is claimed is:

1. A honeycomb core diaphragm, comprising a honeycomb core constructed from a thin plate of beryllium or its alloy having a $\rho$ of 1.75 to 1.85 g/cm$^3$ and a modulus of elasticity of $2.0\times10''$ to $2.3\times10''$N/m$^2$ produced by super-rapid cooling of molten beryllium or beryllium alloy.

2. A honeycomb core diaphragm, comprising; a honeycomb shaped structure comprising a plurality of shaped beryllium segments having a $\rho$ of 1.75 to 1.85 g/cm$^3$ and a modulus of elasticity of $2.0\times10''$ to $2.3\times10''$N/m$^2$, said segments being secured to one another in a honeycomb configuration.

3. A honeycomb core diaphragm as claimed in claim 2, said beryllium segments being adhesively secured together.

4. A honeycomb core diaphragm as claimed in claim 2, said beryllium segments being produced by rapidly cooling a jetted stream of molten beryllium.

5. A method of producing a beryllium or beryllium alloy structure having a $\rho$ of 1.75 to 1.85 g/cm$^3$ and a modulus of elasticity of $2.0\times10''$ to $2.3\times10''$N/m$^2$, comprising; heating a quantity of beryllium until molten, jetting said molten beryllium through a nozzle onto at least one rotating roll rotating at high speed, and rapidly cooling said jetted beryllium using said roll, to form a beryllium strip.

6. A method as claimed in claim 5, said beryllium being jetted under pressure.

7. A method as claimed in claim 5, wherein said molten beryllium is jetted into an area between two adjacent rotating rolls.

8. A method of producing a beryllium or beryllium alloy honeycomb structure having a $\rho$ of 1.75 to 1.85 g/cm$^3$ and a modulus of elasticity of $2.0\times10''$ to $2.3\times10''$N/m$^2$ for a honeycomb core diaphragm, comprising;

heating a quantity of beryllium until molten, and jetting said molten beryllium under pressure through a nozzle onto at least one rotating roll, super-rapidly cooling said beryllium using said roll, to form a sheet like material, forming said sheet into a waveform structure, and securing a plurality of said structures together to form a honeycomb configuration.

9. A method as claimed in claim 8, said structure being secured together by an adhesive.

10. A method as claimed in claim 8, said waveform structure being formed by cold press molding said sheets.

11. A method as claimed in claim 8, wherein said molten beryllium is jetted into a space between a pair of rotating rolls.

12. A honeycomb core diaphragm, comprising; a plurality of corrugated beryllium or beryllium alloy strips having a $\rho$ of 1.75 to 1.85 g/cm$^3$ and a modulus of elasticity of $2.0\times10''$ to $2.3\times10''N/m^2$ secured to one another to form a honeycomb configuration, said strips being formed by rapidly cooling molten beryllium in strip form, and pressing to form corrugations.

13. A method as claimed in claim 8, said honeycomb configuration being sandwiched between thin sheets of beryllium formed by rapidly cooling a jetted width of molten beryllium.

* * * * *